US010099152B1

(12) United States Patent
Blumhagen

(10) Patent No.: US 10,099,152 B1
(45) Date of Patent: Oct. 16, 2018

(54) TIE PUPPET

(71) Applicant: Mark C. Blumhagen, Spokane Valley, WA (US)

(72) Inventor: Mark C. Blumhagen, Spokane Valley, WA (US)

( * ) Notice: Subject to any disclaimer, the term of this patent is extended or adjusted under 35 U.S.C. 154(b) by 0 days.

(21) Appl. No.: 15/732,229

(22) Filed: Oct. 10, 2017

(51) Int. Cl.
*A63H 3/14* (2006.01)
*A41D 25/00* (2006.01)

(52) U.S. Cl.
CPC ..... *A63H 3/14* (2013.01); *A41D 25/00* (2013.01)

(58) Field of Classification Search
None
See application file for complete search history.

(56) References Cited

U.S. PATENT DOCUMENTS 1,997,650 A * 4/1935 Ozmon ..... A41D 25/022 24/49.1
2,948,936 A * 8/1960 Winthrop ..... A44B 6/00 24/66.11
3,317,095 A * 5/1967 Kerns ..... A44B 6/00 2/145
3,881,196 A * 5/1975 Spada ..... A41D 25/00 2/152.1
4,159,542 A * 7/1979 Pehr ..... A41D 25/022 24/66.11
5,815,835 A * 10/1998 Craddock ..... A41D 25/00 2/144
5,884,333 A * 3/1999 Soliman ..... A41D 25/022 2/145
D437,471 S * 2/2001 Harris ..... D2/605
6,195,847 B1 * 3/2001 Shemberger ..... A01K 83/00 24/163 K
7,717,335 B2 * 5/2010 Halbur ..... A63H 3/08 235/380
D620,741 S * 8/2010 Pride-Darrington ..... D6/608
8,230,557 B2 * 7/2012 McNeil ..... A44B 6/00 2/144

* cited by examiner

*Primary Examiner* — John E Simms, Jr.
*Assistant Examiner* — Urszula M Cegielnik

(57) ABSTRACT

A tie puppet assembly that removably attaches to a standard tie. The tie puppet is located on the reverse side of the outer tie panel. The puppet features including tubular fabric member, a face panel member and a working V shaped mouth, are designed to lay flat on the back of the tie panel until the user flips the tie panel around and puts his or her hand into the tubular member and fingers into the V shaped mouth assembly, thereby causing the surprise and delight of turning an ordinary neck tie into a moving, talking puppet.

2 Claims, 4 Drawing Sheets

TIE PUPPET

CROSS REFERENCE TO RELATED APPLICATIONS

Not Applicable

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of neck tie accessories and more specifically to a tie puppet.

Hand puppets have been a common novelty toy in use around the world for hundreds of years. The user inserts his or her hand into a likeness of a person or animal, and proceeds to use his or her fingers to animate the puppet's features for the entertainment of others.

Hand puppets have a three dimensional form in order to allow a user to insert his or her hand and to operate the puppet's features. However, in some specialized applications, it would be helpful for the hand puppet to be able to be flattened and hidden when not in use. Although some hand puppets are made of soft fabric and can be made to fold relatively flat, they cannot become as flat as necessary in order to be hidden in the back of a standard neck tie.

Furthermore, current hand puppet assemblies cannot be easily attached or removed from the rear portion of a standard neck tie.

BRIEF SUMMARY OF THE INVENTION

The primary object of the invention is to provide a wearable tie made of fabric that includes an operable puppet feature hidden in the rear portion of the tie.

Another object of the invention is to provide a tie with puppet feature where the puppet feature is capable of lying in a flat format when stored and can then pop out to a three-dimensional format when in use.

Another object of the invention is to provide a tie with puppet feature where the puppet feature is removable from the tie so that the tie and the puppet feature are separately washable and so that the puppet feature may be installed after the tie is knotted.

A further object of the invention is to provide a tie with puppet feature where the puppet feature easily returns to a hidden flat format after use.

Yet another object of the invention is to provide a tie with puppet feature where the puppet feature includes an optional small sound memory chip and associated amplifier and speaker.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed a tie puppet comprising: a tie retaining panel, a character face panel, a V shaped mouth panel, a fabric tube member, a hook fastener member, a loop fastener member, said tie retaining panel and said character face panel joined together at one end, said tie retaining panel sized to fit into the space between the inner and outer layer of a standard neck tie, said V shaped mouth panel attached on each side to said fabric tube member, said character face panel having an integral panel extension whose sides match that of a standard neck tie, said tube member attached on one side to said extension panel of said character face panel, said tie retaining panel having said hook fastener member attached to its underside, said loop fastener member attached to the end portion of said neck tie, and said hook fastener member capable of attaching to said loop fastener member thereby removably securing said invention to said neck tie.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Figure 1:
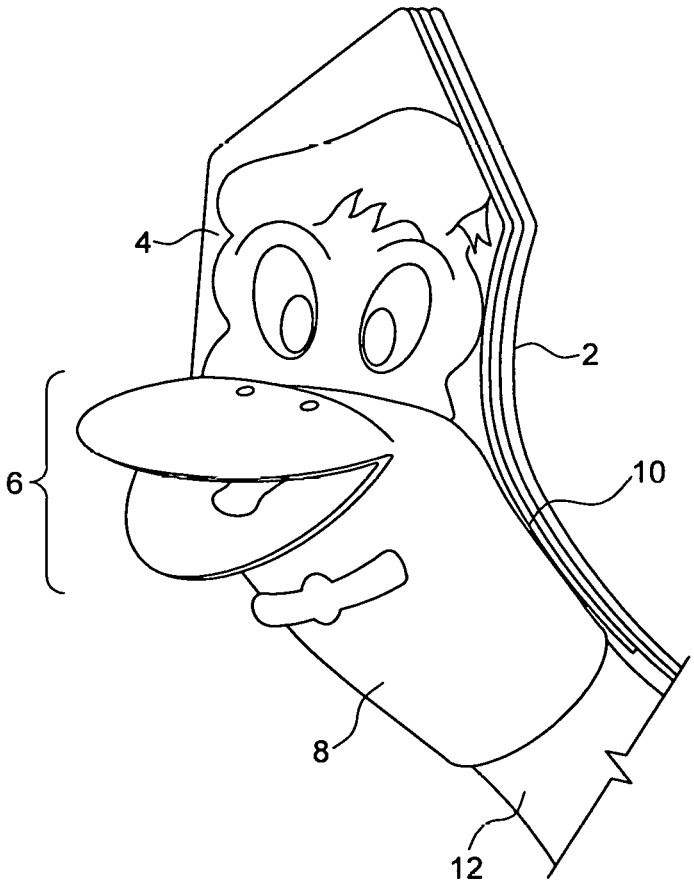
FIG. 1 is a perspective view of the invention while in use as a hand puppet.
Figure 2:
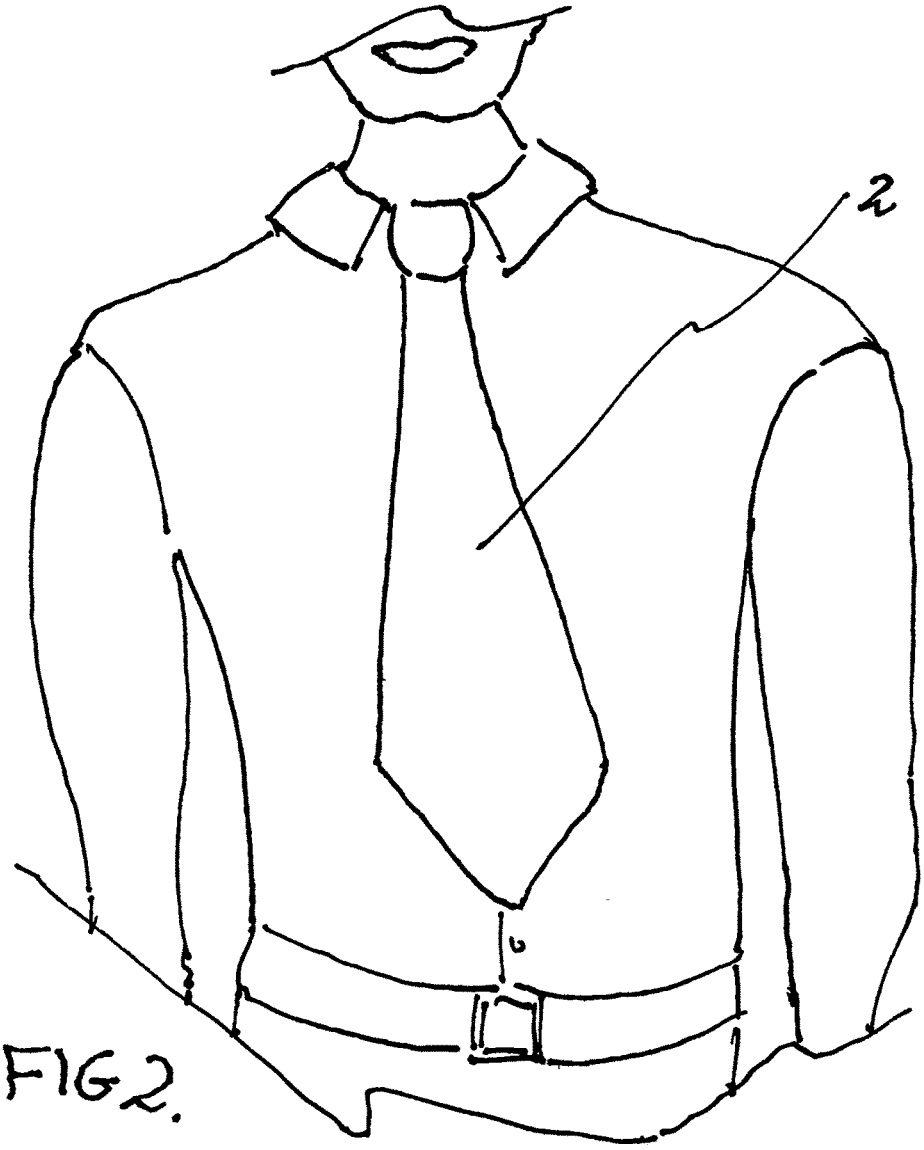
FIG. 2 is a front view of a person wearing a neck tie containing a hidden hand puppet.

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

referring to FIG. 1 we see a perspective view of a person wearing the tie puppet of the present invention. A person's 12 hand is inserted into a fabric tube member 8 and the user's fingers are inserted into a V shaped mouth panel 6 thereby being able to cause the V panel member to open and close as if forming words or sounds. The fabric tube member 8 is attached to a resilient face panel extension 10. A face panel member 4 includes graphics of upper portion of a face including eyes. A tie retaining panel is attached to the top of the face panel member as shown in the side section view in FIGS. 4 and 5, and is inserted into the space between the outer most surface of a standard tie front panel and the inner most surface of the tie front panel.

Figure two shows a person wearing a tie 2 with the present invention attached. As can be seen, the present invention is not detectable from the front view because it is shaped to fit behind the front tie panel in a flat format that does not give away the fact that a hand puppet is stored behind the front tie panel. When the puppet feature is revealed by the user, it elicits surprise and delight form viewers young and old alike.

Figure 3:
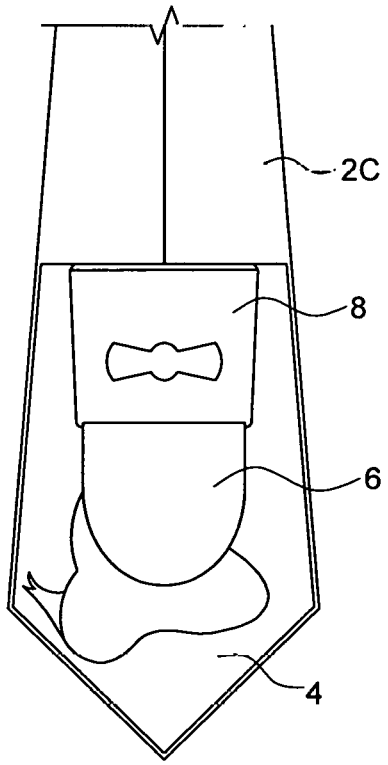
FIG. 3 is a rear view of the hand puppet of the present invention attached to a standard neck tie.

FIG. 3 is a view of the rear surface 2C of the front panel of a standard tie. The tubular fabric member 8 and the V shaped mouth panel member are stored in a flat fashion and are to be found within the borders of the tie 2C so that they are not visible when the tie is worn by a user in a standard fashion.

Figure 4:
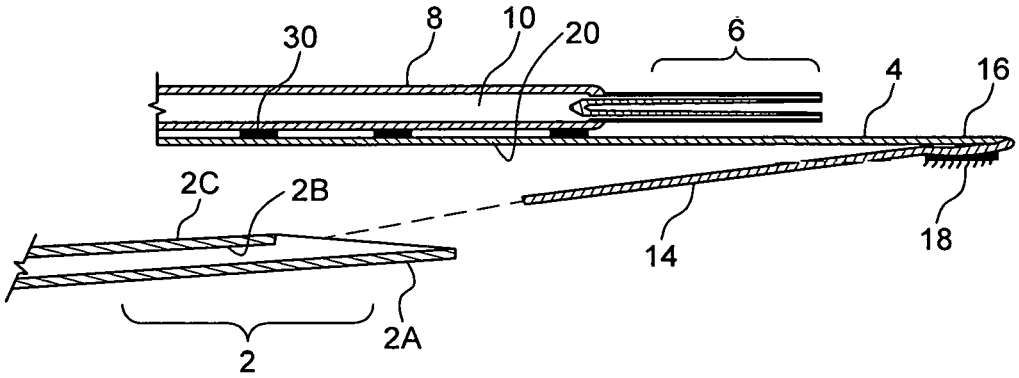
FIG. 4 is a side section view of the invention and of a standard neck tie.

FIG. 4 is a side section view of a standard tie 2 and a section view of the present invention. The tie 2 is comprised of an outer layer 2A, an inner layer 2C and the space between the two 2B. The invention includes a tie retaining panel 14 that is attached at one end 16 to the underside of face panel member 4. the tie retaining panel can slip into the space 2B and can be removably retained there by a hook type fastener mounted on the under the surface of outer tie panel 2A and a loop type fastener 18 mounted to the underside of tie retaining panel 14. This allows the puppet feature to be easily removed so that the tie may be cleaned, or a different puppet feature may be installed. The invention is shown in its flattened form with tubular fabric member 8 and V mouth panel member 6 in a flattened state.

Figure 5:
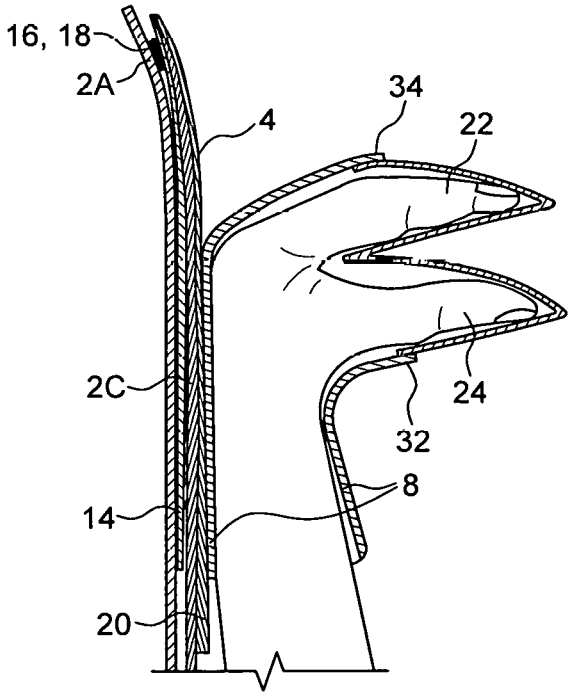
FIG. 5 is a side section view of a person using the invention.

FIG. 5 is a side section view showing the invention in use with the user's thumb 24 and forefinger 22 inserted into the V mouth panel member so that the V panel member can be opened and closed to simulate mouth movements. Tube 8 is attached 30 to face panel extension member 20. V panel member 6 is attached to tube member 8 at 34, 36. Face panel 4 includes upper head features as shown in FIG. 1. Tie retaining panel 20 is inserted in space 2B. Tie retaining panel 20 is attached to tie portion 2A by hook and loop fastener 16, 18.

The graphic features of the invention can represent any type of head including human heads and animal heads. Additionally, representations of arms may also be folded within the boarder of the tie 2 and folded out when in use as a puppet. The front surface of the tie 2 may also include graphic images that relate to the features of the puppet hidden within. The puppet images may be holiday theme such as Santa or an Easter Bunny. Or the facial features may be digitally recreated photographs of actual people or animals including popular sports figures or cartoon animals. Additionally, a small speaker, amplifier and battery power supply can be added to the puppet feature to allow the puppet to speak or make other sounds without human assistance.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A tie puppet comprising:

a tie retaining panel;

a character face panel;

a V shaped mouth panel;

a fabric tube member;

a hook fastener member;

a loop fastener member;

said tie retaining panel and said character face panel joined together at one end;

said tie retaining panel sized to fit into the space between the inner and outer layer of a standard neck tie;

said V shaped mouth panel attached on each side to said fabric tube member;

said character face panel having an integral panel extension whose sides match that of a standard neck tie;

said tube member attached on one side to said extension panel of said character face panel;

said tie retaining panel having said hook fastener member attached to its underside;

said loop fastener member attached to the end portion of said neck tie; and said hook fastener member capable of attaching to said loop fastener member thereby removably securing said invention to said neck tie.

2. A tie puppet as claimed in claim 1 wherein said the tie wearer's hand can fit within said fabric tube member and the thumb and forefingers fingers of said hand can fit between said V shaped mouth panel thereby enabling the user to cause said mouth panel to move in a realistic way.

* * * * *